US011583813B2

(12) United States Patent
Tousek

(10) Patent No.: US 11,583,813 B2
(45) Date of Patent: Feb. 21, 2023

(54) MIXING DEVICE FOR NATURAL PEANUT BUTTER AND OTHER NATURAL NUT BUTTERS

(71) Applicant: James Michael Tousek, Huntsville, AL (US)

(72) Inventor: James Michael Tousek, Huntsville, AL (US)

( * ) Notice: Subject to any disclaimer, the term of this patent is extended or adjusted under 35 U.S.C. 154(b) by 490 days.

(21) Appl. No.: 16/728,105

(22) Filed: Dec. 27, 2019

(65) Prior Publication Data

US 2021/0197147 A1 Jul. 1, 2021

(51) Int. Cl.

| | |
|---|---|
| ***B01F 9/00*** | (2006.01) |
| ***B01F 29/31*** | (2022.01) |
| *B01F 101/10* | (2022.01) |

(52) U.S. Cl.

CPC ..... *B01F 29/31* (2022.01); *B01F 2101/10* (2022.01)

(58) Field of Classification Search

CPC ..... B01F 29/31; B01F 2101/10; B01F 29/64; B01F 29/34; A47J 43/04; A47J 43/24; C12M 27/12

USPC ..... 426/406; 366/200, 213

See application file for complete search history.

(56) References Cited

U.S. PATENT DOCUMENTS

| | | | | |
|---|---|---|---|---|
| 1,940,492 | A | 12/1933 | Gale | |
| 2,597,291 | A | 5/1952 | Clegg | |
| 3,439,901 | A | 4/1969 | McCulloch | |
| 3,739,743 | A | 6/1973 | McKee | |
| 4,523,855 | A | 6/1985 | Walker | |
| 6,193,410 | B1 | 2/2001 | Puckett | |
| 7,047,875 | B1 * | 5/2006 | Eastman, III | A47J 43/04 366/139 |
| 7,229,204 | B2 | 6/2007 | Haskell | |
| 7,229,656 | B2 | 6/2007 | Paumen | |
| 7,670,042 | B2 * | 3/2010 | Cheung | B01F 29/31 366/208 |

* cited by examiner

*Primary Examiner* — Elizabeth Insler
(74) *Attorney, Agent, or Firm* — Lanier Ford Shaver & Payne PC; Gerald M. Walsh

(57) ABSTRACT

A mixing device for cylindrical jars, the device having two drive rollers and two guide rollers extending upward from a housing and through a top surface of the housing. The rear end of the top surface has a stop member. The drive rollers on one side of the jar and the guide rollers on an opposite side of the jar are mounted on axles positioned in the interior of the housing, wherein the axles slant downward 2 to 45 degrees from the front end to the rear end of the housing. A motor and transmission in the housing are connected operatively to the drive rollers. The drive rollers will rotate the jar at least 5 RPM with the jar tilted downward. Ajar of natural peanut butter rotated for 5 to 20 minutes will remain uniformly mixed for a week.

15 Claims, 3 Drawing Sheets

MIXING DEVICE FOR NATURAL PEANUT BUTTER AND OTHER NATURAL NUT BUTTERS

FIELD OF THE INVENTION

The present invention pertains to devices that rotate cylindrical containers to mix food therein and more particularly to a mixing device having rollers to rotate ajar of natural peanut butter to mix peanut oil separated from the peanut solids and to form a stable uniform mixture of natural peanut butter.

BACKGROUND OF THE INVENTION

It is known to rotate cylindrical containers, such as jars, to churn milk, marinate food, and toss salads (see for example, U.S. Pat. Nos. 2,597,291; 7,047,875; 7,670,042; and 7,229,656). However, these devices have not been useful for mixing natural peanut butter which normally separates into an oil layer on top of peanut solids.

Peanut butter is a food paste or spread made from ground dry-roasted peanuts. It often contains additional ingredients that modify taste and texture, such as salt, sweeteners, or emulsifiers. Peanut butter is popular in many countries, being flavorful and nutritious with a relatively high protein content. The United States is a leading exporter of peanut butter and itself consumes $800 million of peanut butter annually. Commercial peanut butter is a mixture of oil, water and solids.

Natural peanut butter retains the natural peanut oil with no additives but has the unfortunate inconvenience of needing to be stirred before it can be used. It is common for a jar of natural peanut butter at the grocery store to have a layer of liquid peanut oil ½ inch or more thick floating on top of the solids and water. Stirring natural peanut butter to an even consistency is laborious and often messy because of peanut butter's thick consistency and the tendency of the peanut oil to spill over the sides of the jar. The industry solution has been to replace the peanut oil with saturated oils that are solid at room temperature and therefore don't separate. However, saturated oils are considered to be less healthy than unsaturated oils. Mechanical solutions have been developed in the form of hand turning cranks or hand-held motorized wands. While effective for mixing the natural peanut butter, these devices must be inserted into the peanut butter and so must be cleaned after use, which is inconvenient and undesirable. What is needed is a device that will mix the natural peanut butter in the jar externally without having to open the jar.

SUMMARY OF THE INVENTION

The present invention is a mixing device for cylindrical containers having a housing with a front end, a rear end, a left side, a right side, a top surface, a bottom end, and an interior. The top surface has two drive rollers and two guide rollers and a stop member at the rear end of the top surface. The drive rollers and the guide rollers are constructed to cradle a jar and rotate the jar. The rollers near the rear end are positioned lower in the housing than rollers near the front end. The drive rollers and the guide rollers are mounted on axles positioned in the interior of the housing, wherein the axles slant downward from the front end to the rear end. Preferably, the axles slant downward 2 to 45 degrees. The drive rollers are positioned near one side of the housing and the guide rollers are positioned near a second opposite side of the housing. A motor and transmission in the interior of the housing are operatively connected to the drive rollers.

The drive rollers and guide rollers extend above the top surface by passing through slots in the top surface. The drive rollers are constructed to rotate a cylindrical container between 5 and 200 RPM. The transmission may be positioned between the drive rollers and the motor may be positioned between the guide rollers.

This invention provides a method of mixing natural peanut butter in a cylindrical container. The container is rotated horizontally along its longitudinal axis. The top end of the container is tilted downward 2 to 45 degrees. Preferably, the container is rotated 5 to 200 RPM with a pair of drive rollers on one side of the container and a pair of guide rollers on an opposite side of the container. The natural peanut butter can also be mixed in this manner by tilting the container upward 2 to 45 degrees instead of downward.

An advantage of the mixing device of this invention is that it automatically stirs natural peanut butter in the jar without contacting the peanut butter or requiring opening the jar.

Another advantage is there is no cleanup of oil and peanut butter after mixing.

Another advantage is that it only takes a few minutes to complete mixing and once mixed the natural peanut butter will stay mixed for a week or more at room temperature, and longer if refrigerated.

Another advantage is a mixing device that is inexpensive to manufacture, compact, and easy to use.

Another advantage a mixing device in which the jar self-aligns along its longitudinal axis as it spins.

DETAILED DESCRIPTION OF THE INVENTION

While the following description details the preferred embodiments of the present invention, it is to be understood that the invention is not limited in its application to the details of arrangement of the parts described in the disclosure or illustrated in the accompanying figures, since the invention is capable of other embodiments and of being practiced in various ways.

The present invention is a mixing device for cylindrical containers that mixes contents in the container by rotating the container. The device is particularly useful for mixing the oil, water and solids in natural peanut butter that has separated upon standing.

Figure 1:
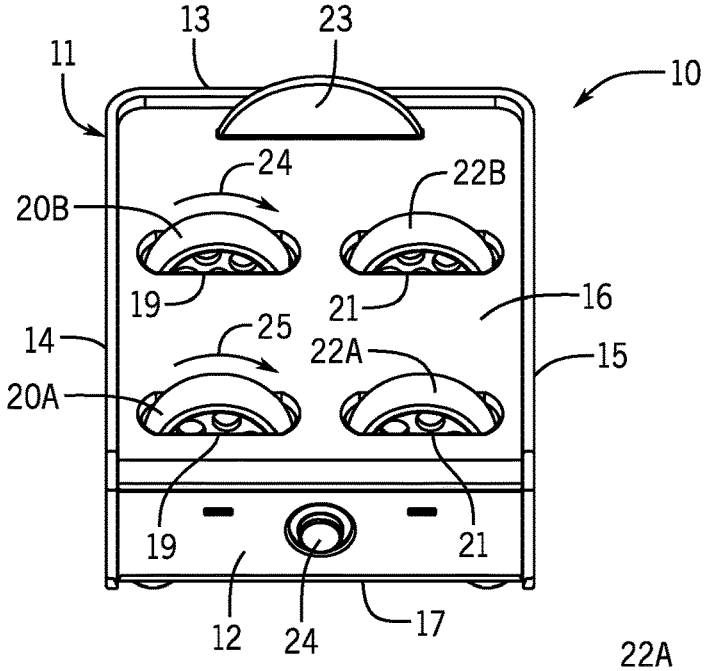
FIG. 1 is a front, top perspective view of a mixing device of the present invention.

FIG. 1 shows a front, top perspective view of the mixing device 10 of the present invention. The mixing device 10 is formed of a housing 11 having a front end 12, a rear end 13, a left side 14, a right side 15, a top surface 16, and a bottom end 17, forming an interior 18 (see FIG. 4). The top surface 16 has a pair of slots 19 near the left side 14 of the housing 11. A drive roller extends up through each slot 19, one drive roller 20A near the front end 12 and another drive roller 20B near the rear end 13. The top surface 16 has a pair of slots 21 near the right side 15 of the housing 11. A guide roller extends up through each slot 21, one guide roller 22A near the front end 12 and another guide roller 22B near the rear end 13. The pair of rollers 20A and 22A near the front end 12 and the pair of rollers 20B and 22B near the rear end 13 form a cradle for a cylindrical container (see FIGS. 5 and 6). The top surface 16 has a stop member 23 near the rear end 13 and an on/off pushbutton 24 on the front end 12.

Figure 2:
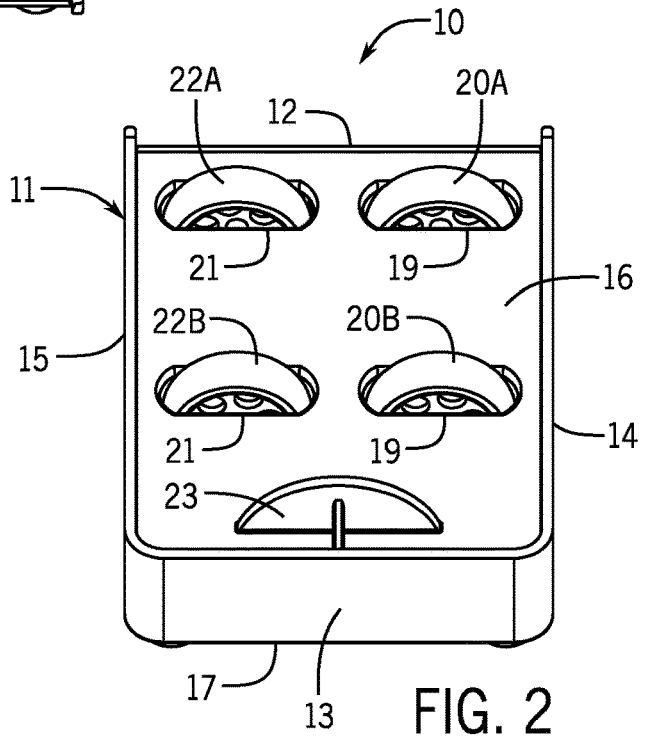
FIG. 2 is a rear, top perspective view of mixing device.
Figure 3:
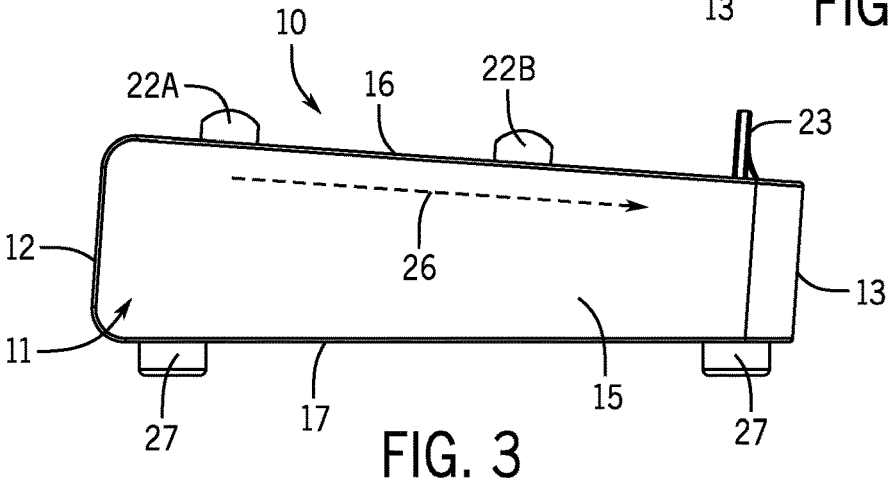
FIG. 3 is a right-side elevation view of the mixing device.

FIG. 2 shows a rear top perspective view of mixing device 10. FIG. 3 shows a right-side elevation view of the mixing device 10. The rollers 20B and 22B near the rear end 13 are positioned lower in the housing 11 than the rollers 20A and 22A near the front end 12 so that tops of the rollers near the rear end 13 are lower than tops of the rollers near the front end 12. The top surface 16 slants downward from the front end 12 to the rear end 13, as indicated by the arrow 26, to conform to the positioning of the rollers. The housing 11 may have legs or feet 27 to support the housing 11.

Figure 4:
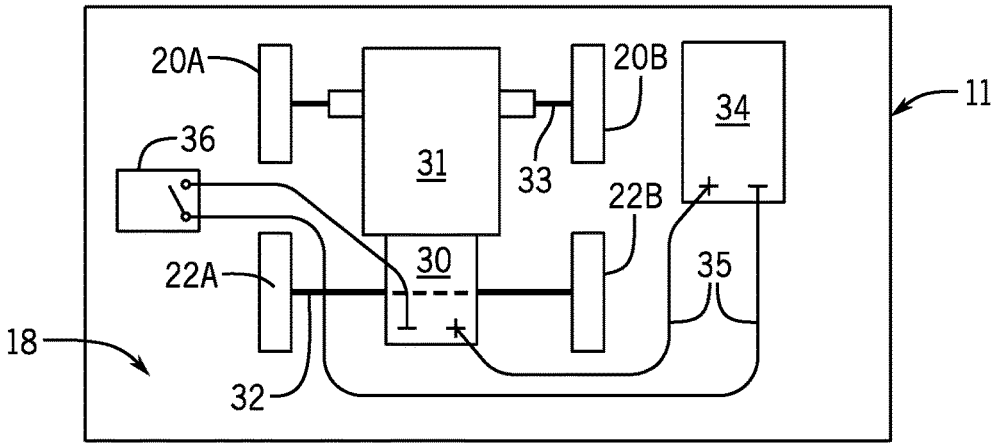
FIG. 4 is an electromechanical schematic showing a top view of electronic and mechanical components of the mixing device.

FIG. 4 is an electromechanical schematic showing a top view of electronic and mechanical components of the mixing device 10 in the interior 18 of the housing 11. An electric motor 30 is operatively connected to a transmission 31. The motor/transmission combination is a preassembled commercially available unit, for example, Shenzhen Dong Hui Intelligent Electronic Co. Part #F130, available on Alibaba.com. An axle 32 is mounted in the housing 11 above the motor 30. The guide rollers 22A and 22B are mounted rotatably on the ends of the axle 32. Drive wheel 20A is mounted to an axle 33 on one side of the transmission 31 and drive wheel 20B is mounted on the axle 33 on an opposite side of the transmission 31. The axle 33 passes through the transmission 31. In this configuration, the motor 30 is positioned between the guide rollers 22A and 22B and the transmission 31 is positioned between the drive rollers 20A and 20B. The axles 32 and 33 may slant downward in the same direction and to the same degree as the top surface. Preferably, the axles 32 and 33 slant downward 2-45 degrees from the front end 12 to the rear end 13, as shown by arrow 26 in FIG. 3. A power supply 34, such as a battery, is connected by electrical wires 35 to the motor 30 and to an on/off pushbutton switch 36, which turns the motor on and off using the on/off pushbutton 24.

Figure 5:
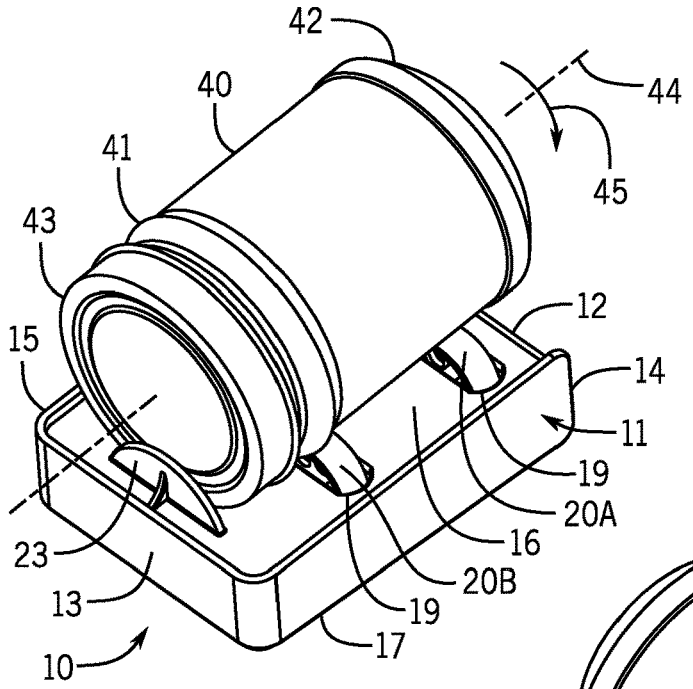
FIG. 5 is a rear, left, top perspective view of a cylindrical container placed on the mixing device with the lid end tilted downward.
Figure 6:
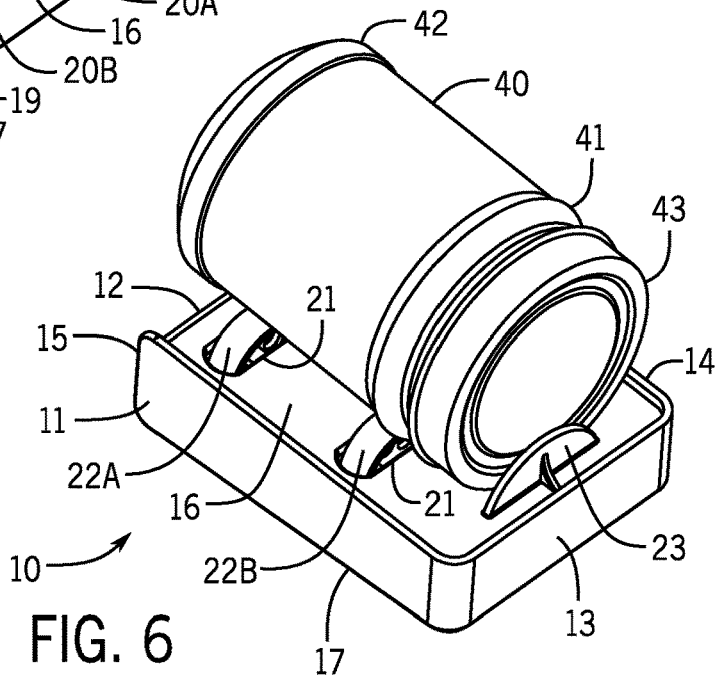
FIG. 6 is a rear, right, top perspective view of the cylindrical container placed on the mixing device with the lid end tilted downward.

FIG. 5 is a rear, left, top perspective view of a cylindrical container 40, such as a peanut butter jar, placed horizontally on the top 16 of the mixing device 10. The jar 40 has a top end 41, a bottom end 42, and a lid 43 on the top end 41. The longitudinal axis of the jar 40 is shown by the dashed line 44. If the drive rollers 20A and 20B rotate clockwise, then the jar 40 will rotate horizontally counterclockwise, shown by arrow 45, around its longitudinal axis. The jar 40 is cradled on the drive rollers 20A and 20B and on the guide rollers 22A and 22B with the lid 43 contacting the stop member 23. In this configuration, the jar 40 will remain on the mixing device 10 when the jar is rotated by the drive rollers 20A and 20B. In addition, the top end 41 of the jar 40 is tilted downward because the axles 32 and 33 are slanted downward from the front end 12 to the rear end 13. FIG. 6 is a rear, right, top perspective view of the cylindrical container 40 placed on the top 16 of the mixing device 10.

The mixing device as shown in the figures, for example, is about 5 inches in length, about 3.75 inches wide, about 1.5 inches high at the front end, and about 1.25 inches high at the rear end. The angle of tilt from the front end of the mixing device to the rear end of the device is about 2 to 45 degrees, preferably about 5 degrees. The diameter of the wheels is about 1.5 inches and they extend above the top surface about 0.38 inches. The wheels are made, preferably, of rubber. The jar is rotated at about 5 to 200 RPM, preferably 120 RPM. A 9V battery can supply power via a latching pushbutton switch.

Effective mixing of the natural peanut butter, or other natural nut butters such as those from almond or cashew nuts or sunflower seeds, is accomplished by rotating the jar of natural peanut butter along its longitudinal axis at a moderate speed. Preferably, the jar is maintained at a slight downward angle from level, with the lid end pointing slightly downward. The natural peanut butter will also mix with the jar maintained level but mixing is less effective compared to having the lid end of the jar tilted downward. The rotating motion induces mixing action in which the peanut material sticks to the inner wall of the jar and is carried up the jar some distance before losing contact with the inner wall and falling back into the mixture below. The result of this mixing action is a continuous folding together of the contents as they rise to the inner wall and fall. Maintaining the jar at a downward tilt of 2 to 45 degrees enhances the mixing action by taking advantage of the oil's tendency to rise above the peanut solids. The oil starts at the top end of the jar and is moved by its own buoyancy towards the bottom end of the jar which is higher than the top end. This upward movement of the oil causes the oil to mix more effectively with the solids, compared to the front end of the jar not being tilted downward.

The jar can be rotated at a range of speeds, with higher speeds of rotation being more effective. Acceptable mixing occurs at 5 to 200 RPM. At 120 RPM, a typical jar of natural peanut butter can be stirred within five to twenty minutes to get complete mixing of the natural peanut butter.

To operate the mixing device, the jar of natural peanut butter is placed on the rollers with the lid of the jar engaging the stop member. The on/off pushbutton is pressed to turn on the motor and the jar will spin, remaining cradled in the rollers. After five to twenty minutes of spinning, the natural peanut butter will be well mixed with a uniform consistency. The on/off pushbutton is then pressed to turn the motor off. When the jar comes to a rest, it can be removed from the mixing device. Once mixed by the mixing device, the natural peanut butter will stay mixed for a week or more at room temperature and longer if refrigerated.

Figure 7:
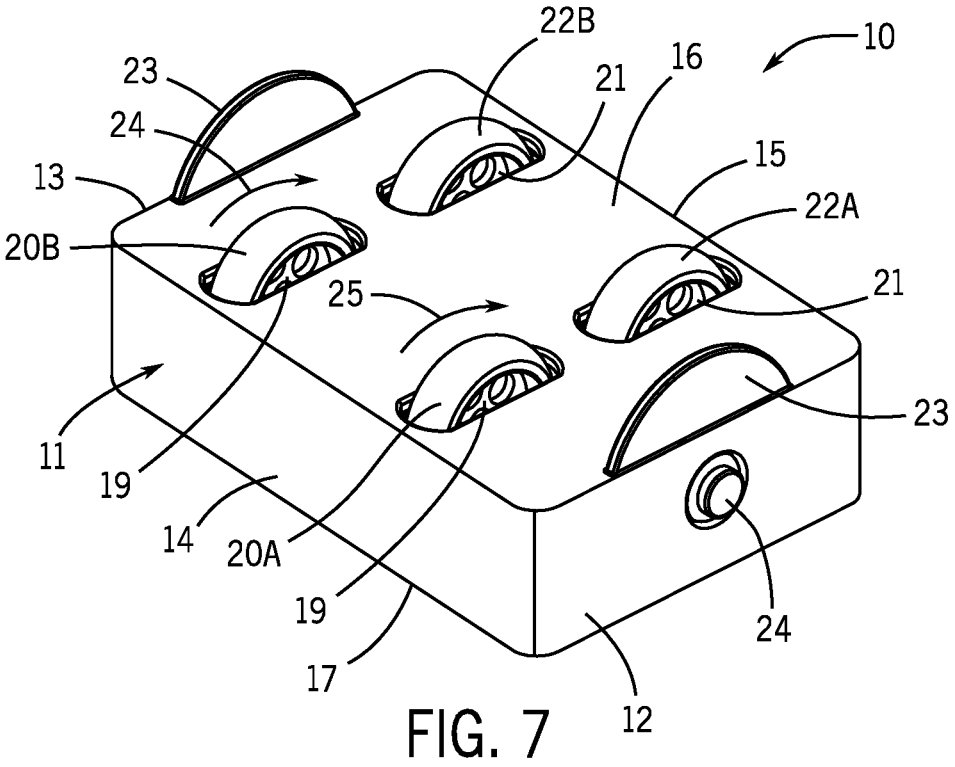
FIG. 7 is a front, left, top perspective view of a mixing device wherein front and rear rollers are level with each other.
Figure 8:
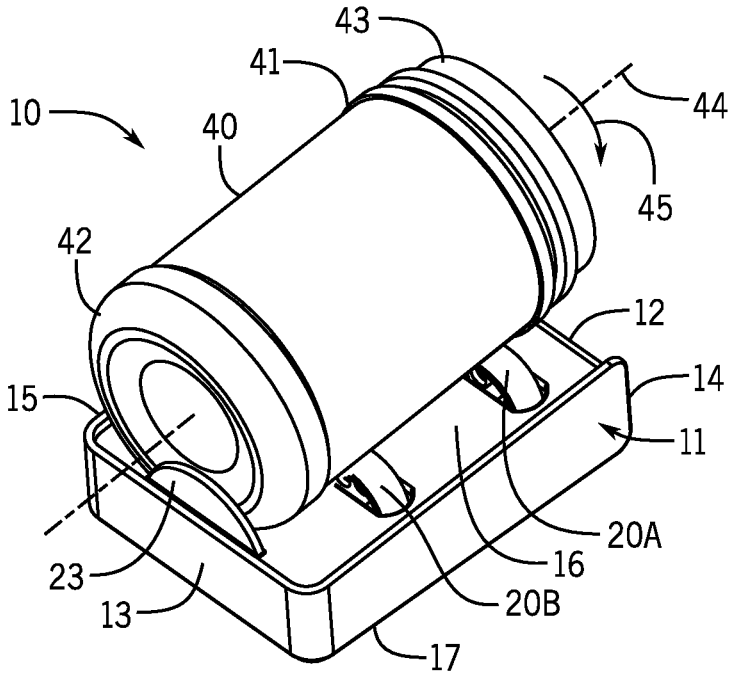
FIG. 8 is a rear, left, top perspective view of a cylindrical container placed on the mixing device with the lid end tilted upward.

The natural peanut butter will also mix with the jar maintained level, but mixing is less effective compared to having the lid end of the jar tilted downward. FIG. 7 shows an embodiment of the invention wherein the top surface 16 and the axles 32 and 33 are level, i.e., not slanted downward from the front end 12 to the rear end 13. In addition, the natural peanut butter can be mixed with the lid end of the jar tilted upward. A lid end-up configuration doesn't stir the solids on the bottom end quite as well as in the lid-down configuration. However, the lid end-up configuration does give a remarkably attractive and smooth appearance to the mixed natural peanut butter. In addition, no peanut butter clings to the underside of the lid when the lid is removed from the jar. FIG. 8 shows a rear, left, top perspective view of a cylindrical container 40, such as a peanut butter jar, placed horizontally on the top 16 of the mixing device 10 with the top end 41 slanted upward 2 to 45 degrees, instead of downward. In this configuration the container 40 is rotated along its longitudinal axis 44 at least 30 seconds.

The foregoing description illustrates and describes the disclosure. Additionally, the disclosure shows and describes only the preferred embodiments but, as mentioned above, it is to be understood that the preferred embodiments are capable of being formed in various other combinations, modifications, and environments and are capable of changes or modifications within the scope of the invention concepts as expressed herein, commensurate with the above teachings and/or the skill or knowledge of the relevant art. The embodiments described herein above are further intended to explain the best modes known by applicant and to enable others skilled in the art to utilize the disclosure in such, or other, embodiments and with the various modifications required by the particular applications or uses thereof. Accordingly, the description is not intended to limit the invention to the form disclosed herein. Also, it is intended that the appended claims be construed to include alternative embodiments.

The invention claimed is:

1. A mixing device for cylindrical containers, comprising:

a) a housing having a front end, a rear end, a left side, a right side, a top surface, a bottom end, and an interior;

b) two drive rollers and two guide rollers on the top surface;

c) the rear end having a stop member on the top surface;

d) the drive rollers and the guide rollers are constructed to cradle a jar and rotate the jar;

e) the drive rollers are mounted on a first axle, wherein the first axle passes through a transmission, and the guide rollers are mounted on a second axle, wherein the second axle is positioned over a motor; and f) a battery in the interior of the housing and connected to the motor.

2. The mixing device of claim 1 further comprising the drive roller and the guide roller near the rear end being positioned lower in the housing than the drive roller and the guide roller near the front end.

3. The mixing device of claim 1, wherein the first and second axles slant downward from the front end to the rear end.

4. The mixing device of claim 3, wherein the axles slant downward 2 to 45 degrees.

5. The mixing device of claim 1, further comprising the drive rollers positioned near one side of the housing and the guide rollers positioned near a second opposite side of the housing.

6. The mixing device of claim 1, further comprising the motor and the transmission in the interior of the housing operatively connected to the drive rollers.

7. The mixing device of claim 1, wherein the drive rollers and guide rollers extend above the top surface by passing through slots in the top surface.

8. The mixing device of claim 1, wherein the drive rollers are constructed to rotate the jar between 5 and 200 RPM.

9. The mixing device of claim 1, wherein the transmission is positioned between the drive rollers and the motor is positioned between the guide rollers.

10. A mixing device for cylindrical containers, comprising:

a) a housing having a front end, a rear end, a left side, a right side, a top surface, a bottom end, and an interior;

b) two drive rollers and two guide rollers on the top surface;

c) the rear end having a stop member on the top surface;

d) the drive rollers and the guide rollers are constructed to cradle a jar and rotate the jar;

e) the drive rollers are mounted on a first axle, wherein the first axle passes through a transmission, and the guide rollers are mounted on a second axle, wherein the second axle is positioned over a motor, and wherein the axles slant downward 2 to 45 degrees from the front end to the rear end;

f) the drive rollers positioned near one side of the housing and the guide rollers positioned near a second opposite side of the housing; and g) the motor and the transmission are in the interior of the housing operatively connected to the drive rollers; and h) a battery in the interior of the housing and connected to the motor.

11. The mixing device of claim 10, wherein the drive rollers and guide rollers extend above the top surface by passing through slots in the top surface.

12. The mixing device of claim 10, wherein the drive rollers are constructed to rotate the jar between 5 and 200 RPM.

13. The mixing device of claim 10, wherein the transmission is positioned between the drive rollers and the motor is positioned between the guide rollers.

14. A mixing device for cylindrical containers, comprising:

a) a housing having a front end, a rear end, a left side, a right side, a top surface, a bottom end, and an interior;

b) two drive rollers and two guide rollers on the top surface;

c) the rear end having a stop member on the top surface;

d) the drive rollers and the guide rollers are constructed to cradle a jar and the drive rollers are constructed to rotate the jar;

e) the drive rollers are mounted on a first axle, wherein the first axle passes through a transmission, and the guide rollers are mounted on a second axle, wherein the second axle is positioned over a motor, and wherein the axles slant downward 2 to 45 degrees from the front end to the rear end;

f) the drive rollers positioned near one side of the housing and the guide rollers positioned near a second opposite side of the housing;

g) the motor and the transmission in the interior of the housing operatively connected to the drive rollers, wherein the drive rollers and guide rollers extend above the top surface by passing through slots in the top surface and wherein the drive rollers are constructed to rotate the jar between 5 and 200 RPM; and h) a battery in the interior of the housing and connected to the motor.

15. The mixing device of claim 14, wherein the transmission is positioned between the drive rollers and the motor is positioned between the guide rollers.

* * * * *